US007250836B2

(12) United States Patent
Fleege et al.

(10) Patent No.: US 7,250,836 B2
(45) Date of Patent: Jul. 31, 2007

(54) TERMINAL SUPPORT FOR A CIRCUIT BREAKER TRIP UNIT

(75) Inventors: Dennis W. Fleege, Cedar Rapids, IA (US); Randall L. Siebels, Cedar Rapids, IA (US); Allen L. Lukas, Amana, IA (US)

(73) Assignee: Square D Company, Palatine, IL (US)

( * ) Notice: Subject to any disclaimer, the term of this patent is extended or adjusted under 35 U.S.C. 154(b) by 140 days.

(21) Appl. No.: 10/816,722

(22) Filed: Apr. 1, 2004

(65) Prior Publication Data

US 2005/0217985 A1 Oct. 6, 2005

(51) Int. Cl.
*H01H 75/00* (2006.01)

(52) U.S. Cl. ..... 335/6; 335/202; 439/810

(58) Field of Classification Search ..... 335/23–25, 335/35–42, 16, 147, 195; 439/810
See application file for complete search history.

(56) References Cited

U.S. PATENT DOCUMENTS

| | | | | |
|---|---|---|---|---|
| 3,534,195 | A * | 10/1970 | Palmieri et al. | 200/278 |
| 4,654,490 | A * | 3/1987 | Leone et al. | 218/33 |
| 6,448,876 | B1 | 9/2002 | Malingowski et al. | 335/35 |
| 6,556,111 | B2 * | 4/2003 | Felden et al. | 335/172 |
| 2002/0093404 | A1 * | 7/2002 | Malingowski et al. | 335/35 |

* cited by examiner

*Primary Examiner*—Kyung S. Lee
*Assistant Examiner*—Bernard Rojas

(57) ABSTRACT

A terminal assembly for use in a circuit breaker. The terminal assembly includes a first member and a second member abutting the first member. The second member includes a pair of protruding arms to be inserted into a corresponding pair of recesses in a circuit breaker housing. Because the pair of protruding arms are inserted into the housing, the first member is protected against rotational force.

12 Claims, 7 Drawing Sheets

TERMINAL SUPPORT FOR A CIRCUIT BREAKER TRIP UNIT

FIELD OF THE INVENTION

The present invention relates generally to circuit breakers, and more specifically to a terminal support in a circuit breaker.

BACKGROUND OF THE INVENTION

Circuit breakers typically provide automatic current interruption to a monitored circuit when undesired overcurrent conditions occur. These overcurrent conditions include, for example, overloads, ground faults, and short-circuits. An overcurrent is usually detected when the fault current generates sufficient heat in a strip composed of a resistive element or bimetal to cause the strip to deflect. The deflection triggers a trip assembly that includes a spring-biased latch mechanism to force a movable contact attached to a movable blade away from a stationary contact, thereby breaking the circuit. The strip is typically coupled to a heater which conducts the current-generated heat to the strip in a known manner. The current (within a predetermined threshold) at which the trip assembly is just prevented from acting yields the current rating for the circuit breaker. When the circuit is exposed to a current above that level for a predetermined period of time, the trip assembly activates and tripping occurs thereby opening the circuit.

The circuit breaker includes a line end and a load end, both of which include lug assemblies to attach conductive cable to supply electrical current to various loads in the electrical circuit. The load lug assemblies contains a load terminal assembly, and consists of a lug body and a lug screw. The lug screw tightens to hold the conductive cable within the lug body. As the lug screw is tightened, the conductive cable is compressed, and an electrical connection is established between the load terminal assembly and the conductive cable.

However, as the lug is tightened onto the conductive cable, the rotational force, or torque, that is applied to the lug also exerts a force onto the main load terminal. When a high torque is applied to the main load terminal, it is permanently deformed at its bends. This can change its position, which effects the calibration of the tripping system.

Another disadvantage to the above approach is that for as the torque is applied to the lug, it is also transferred onto the circuit breaker base. This force can sometimes be high enough to cause cracking and breaking of the circuit breaker base.

SUMMARY OF THE INVENTION

In an embodiment, a terminal assembly for use in a circuit breaker includes a first member and a second member abutting the first member. The second member includes a pair of protruding arms to be inserted into a corresponding pair of recesses in a circuit breaker housing. Because the pair of protruding arms are inserted into the housing, the first member is protected against rotational force.

In another embodiment of the present invention, a load terminal assembly for use in a circuit breaker, includes a main load terminal to connect a bimetal strip to the conductive cable. A load brace is located on top of the main load terminal, and has at least one tab extending past the main load terminal to fit into a corresponding pocket of a circuit breaker housing.

In accordance with another embodiment of the present invention, a method of assembling a terminal assembly for use in one of a plurality of circuit breakers includes providing a main load terminal and a load terminal brace. The load terminal brace has at least one tab extending out past a formed end. The load terminal brace is placed over the main load terminal such that that the at least one tab extends out past the main load terminal. The at least one tab extends into at least one aperture in a circuit breaker housing.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
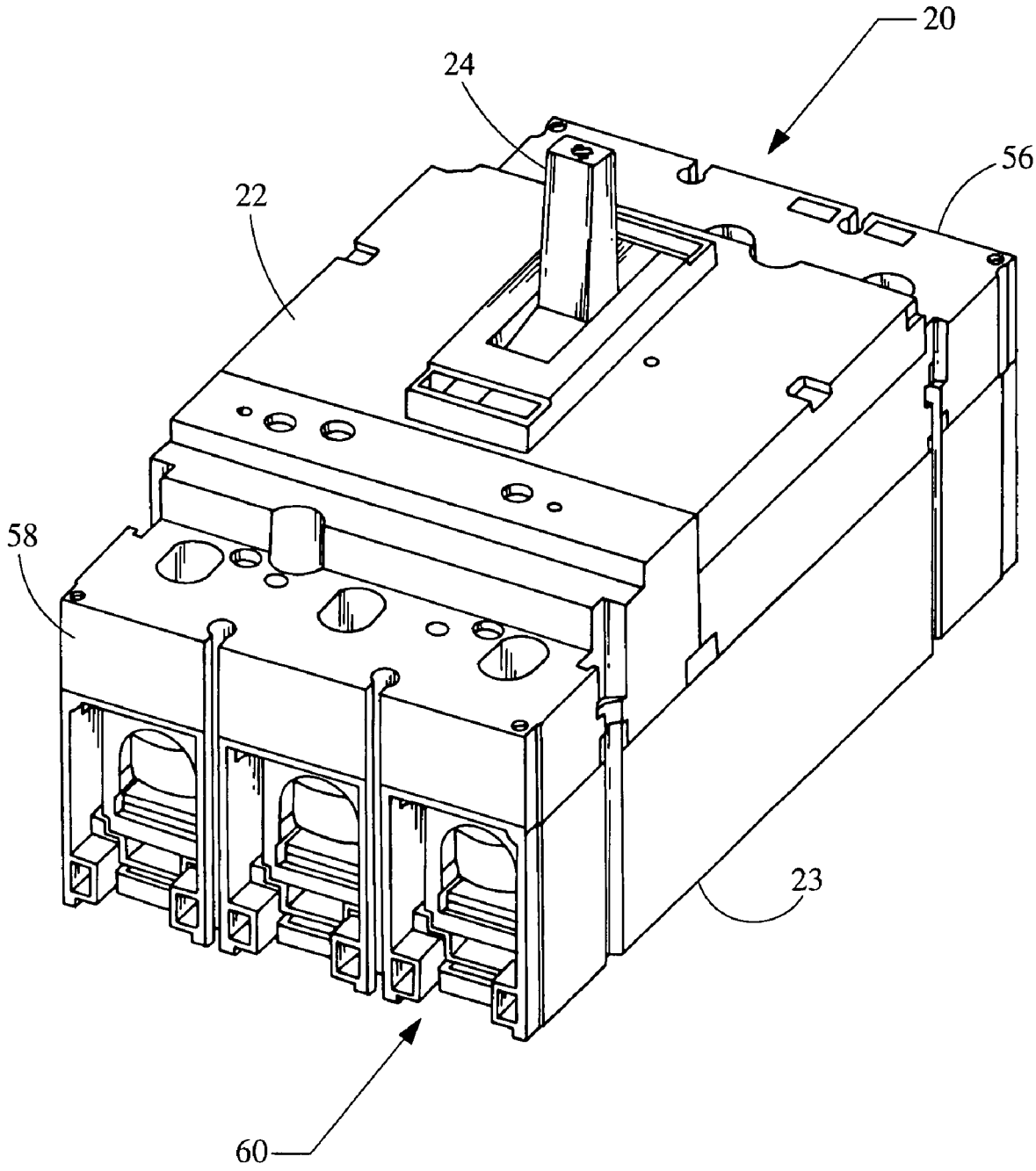
FIG. 1 is a perspective view of a circuit breaker according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
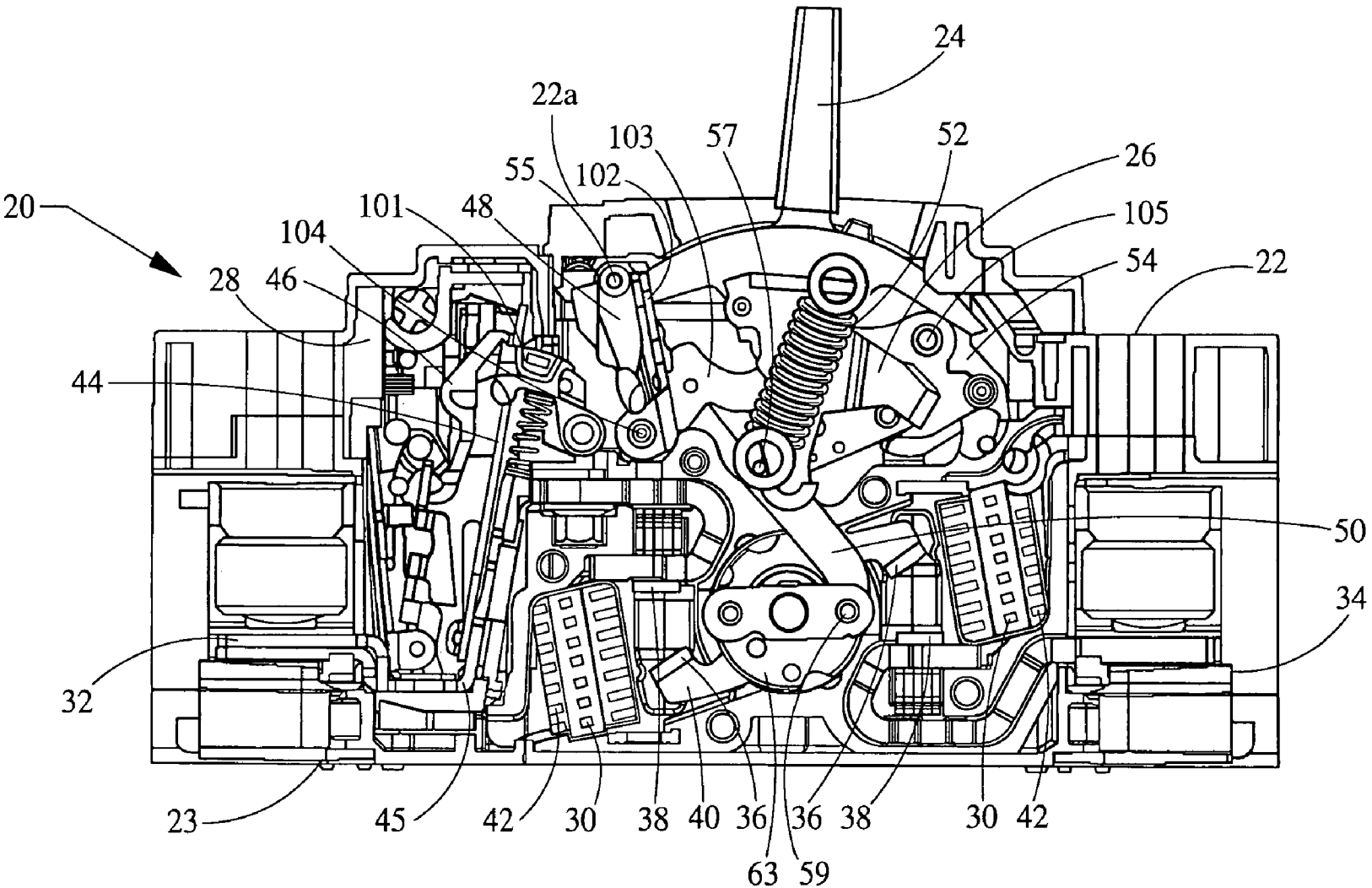
FIG. 2 is a cross-sectional view of the circuit breaker of FIG. 1.

Referring now to the drawings, and initially to FIGS. 1 and 2, an electro-mechanical device such as a circuit breaker 20 will be described in general. The circuit breaker 20 generally includes a cover 22, a base 23, a handle 24, a switching mechanism 26, a trip assembly 28, and an arc-extinguishing assemblies 30.

In general, most components of the circuit breaker 20 are installed on the base 23 and secured therein after a cover 22 and finish cover 22*a* are attached to the base. The handle 24 protrudes through the cover 22*a* for manual resetting or switching on or off the circuit breaker 20. The handle 24 is also adapted to serve as a visual indication of one of several positions of the circuit breaker 20. One position of the circuit breaker 20 is an ON position. When the circuit breaker 20 is in the ON position, current flows unrestricted through the circuit breaker 20 and, therefore, through the electrical device or circuit that the circuit breaker is designed to protect. Another position of the circuit breaker 20 is a TRIPPED position, which is shown in FIGS. 1 and 2. The TRIPPED position interrupts the flow of current through the circuit breaker 20 and, consequently, through the electrical device or circuit that the circuit breaker is designed to protect.

The TRIPPED position is caused by the presence of a higher current than the rated current for the circuit breaker 20 over a specified period of time. The exposure of the circuit breaker 20 over the specified period of time to a current that exceeds the rated current by a predetermined threshold activates the trip assembly 28. Activation of the trip assembly 28 causes the switching mechanism 26 to interrupt current flow through the circuit breaker 20.

Current enters the circuit breaker 20 through a first contact 32 and exits the circuit breaker 20 through a second contact 34. The current also passes through two pairs of contacts, moveable contacts 36 and stationary contacts 38. The movable contacts 36 are attached to a blade 40, which is connected to the switching mechanism 26. In the ON position the movable contacts 36 contacts the stationary contacts 38, while in the TRIPPED position, the movable contacts 36 are separated from the stationary contacts 38, as shown in FIG. 2.

The trip assembly 28 is an assembly that drives the tripping action and generally includes a bimetal strip 44 connected to a main load terminal 68 which acts as the heater 45. The bimetal strip 44 is thermally deflectable and is positioned proximate a trip cross bar 46. Current passing through the heater 45 generates heat which is conducted from the heater 45 to the bimetal strip 44. The higher the current, the more heat is generated. As the bimetal strip 44 is heated, it begins to deflect toward the trip cross bar 46. Continued deflection of the bimetal strip 44 eventually causes the trip cross bar 46 to activate a tripping hammer 101 which then will activate the switching mechanism 26, which in turn causes the movable contacts 36 connected to the blade 40 to move away from the stationary contacts 38. As explained above, the switching mechanism 26 is activated when the current exceeds the rated current by a predetermined threshold over a specified period of time.

As the blade 40 moves away from the stationary contact 38, it passes through the arc-extinguishing assemblies 30 which dissipates electrical arcs that are generated during separation of the movable contact 36 from the stationary contact 38. The arc-extinguishing assemblies 30 includes an arc stack having a number of arc plates 42 which are offset at equal distances from one another and are supported by an insulating plate. The plates 42 are generally rectangular in shape, identical to one another, and interconnected. Each plate 42 has an arc throat that creates a path for the blade 40 to open when the circuit breaker 20 is tripped, or to close when the circuit breaker 20 is closed. The path is formed by laterally offsetting the identical arc plates 42 relative to one another in the same direction. The arc plates are in a straight line with on another.

The switching mechanism 26 generally includes a trip lever 48, trip plate 102, a trip arm 103, lower link 50, an upper link 52, and a frame structure 54. The trip lever 48 is pivotally connected by a trip lever pin 55 to the frame structure 54. The trip plate 102 is pivotally connected by a trip plate pin 104 to the frame structure 54, The trip arm 103 is pivotally connected to the frame structure 54 by a pin 105, and by an upper pin (not shown) to the upper link 52. The upper link 52 is connected by a joint pin 57 to the lower link 50, which is in turn connected by a blade carrier pin 59 to a blade carrier assembly 63.

The circuit breaker 20 also includes a line end 56 and a load end 58. The load end 58 includes a load lug assembly 60 and the line end 56 includes a line end lug assembly 62.

Figure 3:
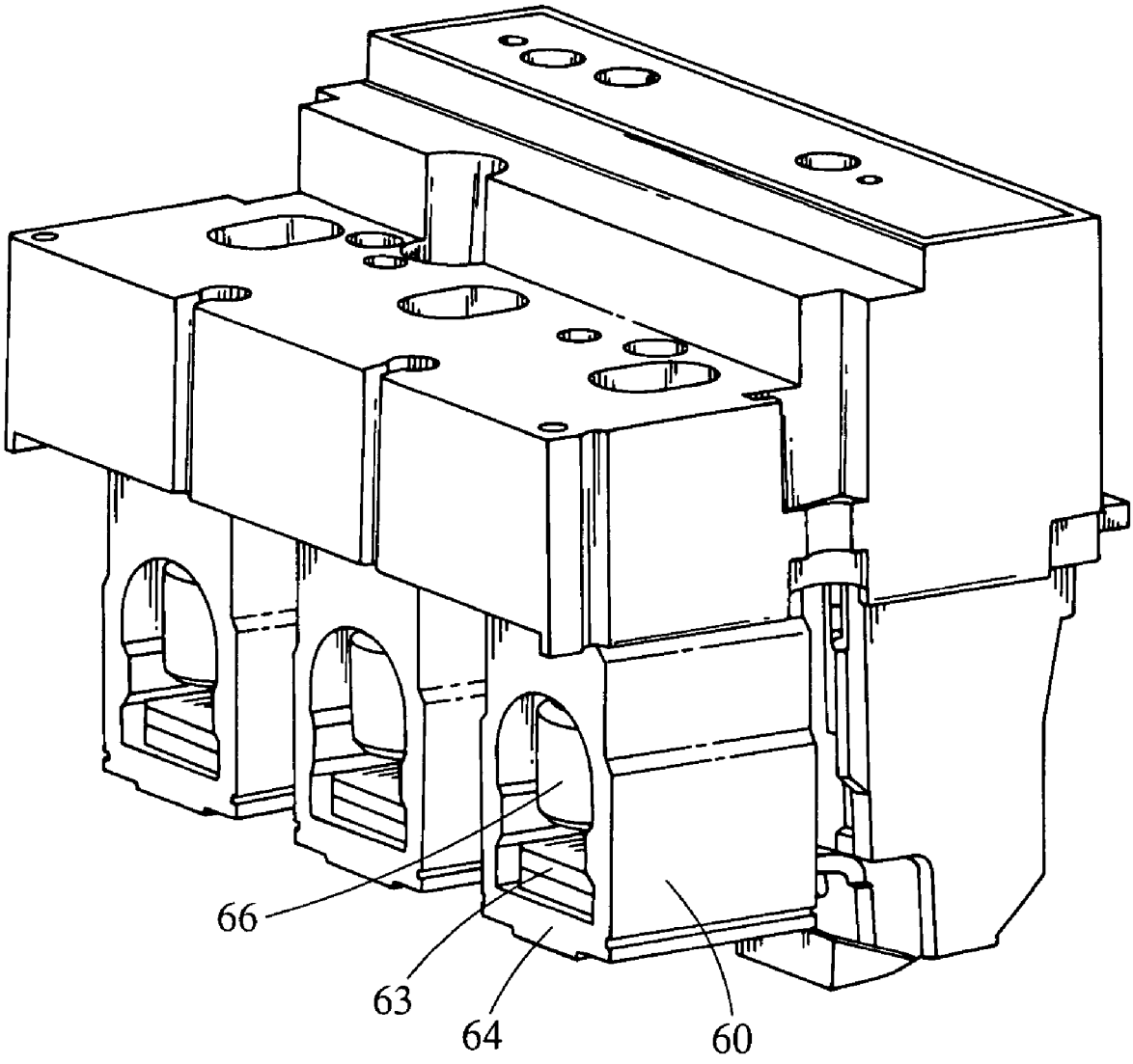
FIG. 3 is a perspective view of a load terminal assembly of the circuit breaker of FIG. 1.

As shown in FIG. 3, the load end 58 is shown in more detail. The load lug assembly 60 partially contains a load terminal assembly 63 (which contains the first contact 32) and consists of two parts, the lug body 64 and the lug screw 66. The lug screw 66 is used to retain a conductive cable (not shown) into the lug body 64. As the lug screw 66 is tightened, the conductive cable is compressed between the lug screw 66 and the load terminal assembly 63.

Figure 4:
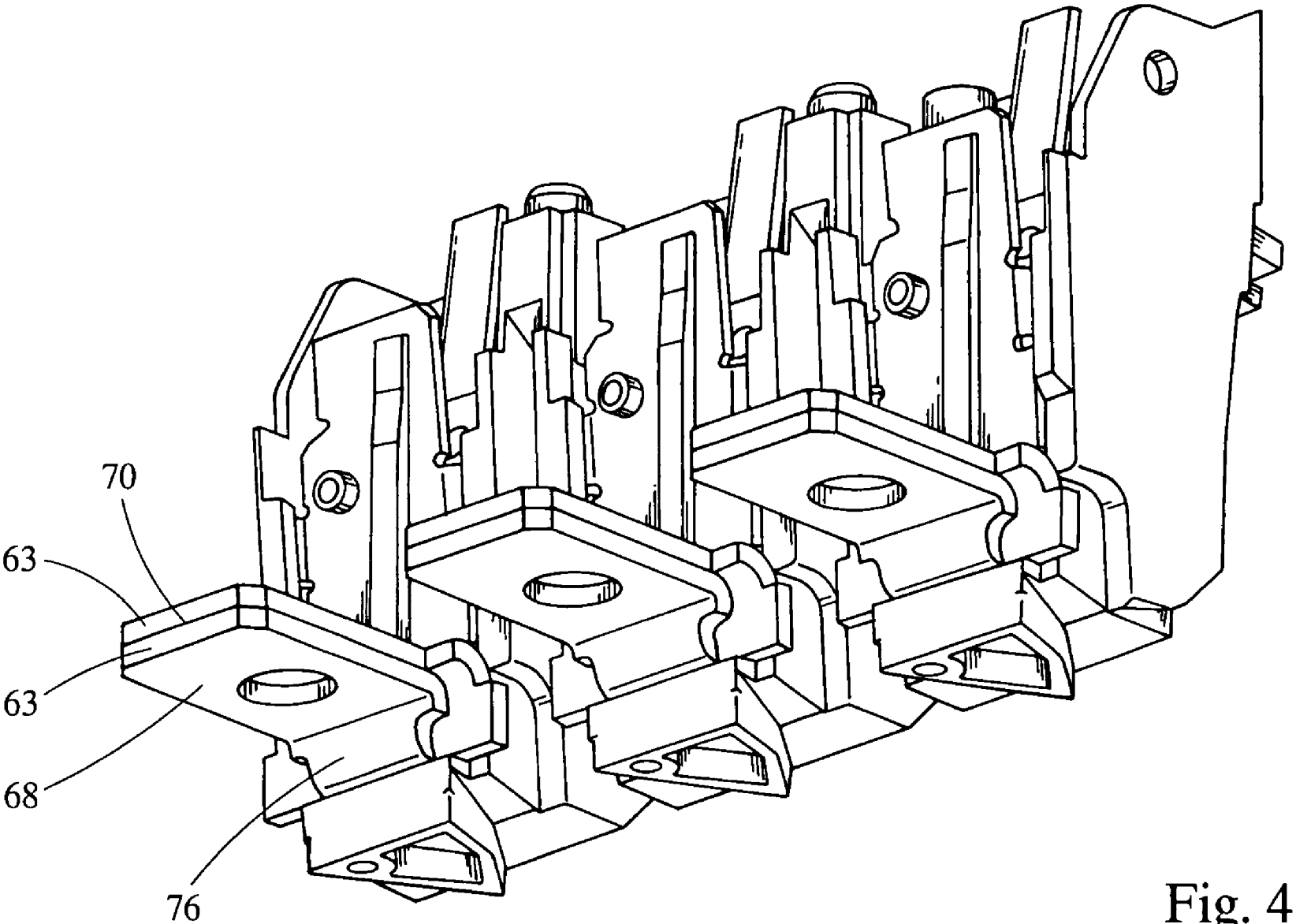
FIG. 4 is another perspective view of the load terminal assembly of FIG. 3.

Turning now to FIG. 4, the load terminal assembly 63 includes a main load terminal 68 and a load terminal brace 70. The main load terminal 68 has a first arm 72 and a second arm 74 (shown in FIG. 6). The two arms 72, 74 change the elevation in which the main load terminal 68 enters the trip assembly 28. The two arms 72, 74 are generally parallel to one another and are connected to each other through a curved bend 76.

Figure 5:
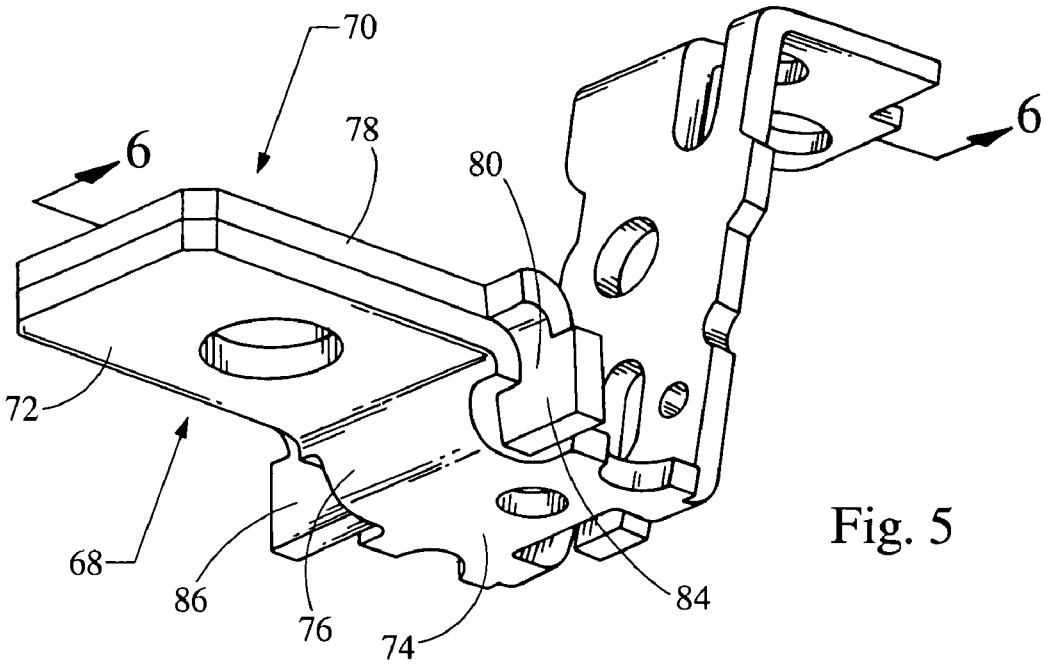
FIG. 5 is a perspective view of a main load terminal and a load terminal brace according to one embodiment of the present invention.
Figure 6:
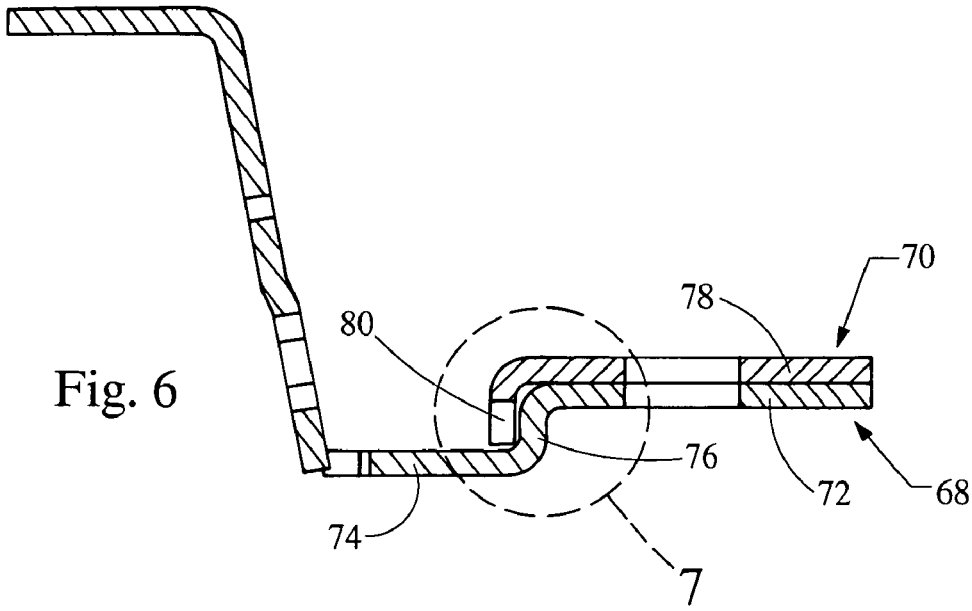
FIG. 6 is a cross-sectional view of FIG. 5 taken along the lines 6-6.
Figure 7:
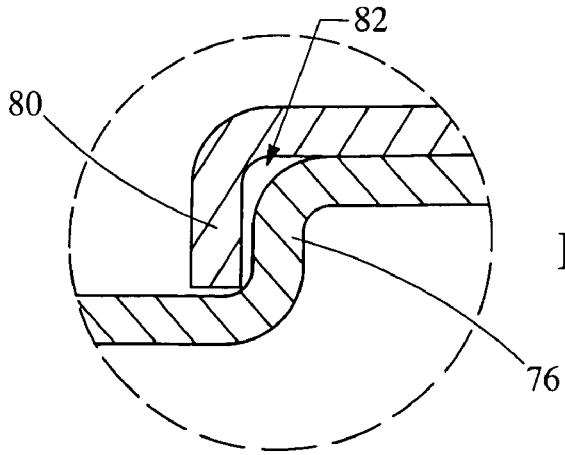
FIG. 7 is a blown-up view of the portion of FIG. 6 labeled "7."

Referring now to FIGS. 5 and 6, the load terminal brace 70 is located on top of the main load terminal 68 and includes a first end 78 and a second end 80, which is generally perpendicular to the first end 78. The first end 78 of the brace 80 abuts the first arm 72 of the main load terminal 68. The second end 80 of the brace is positioned such that there is a gap 82 between the second end 80 of the brace 70 and the curved bend 76 of the main load terminal 68. This gap provides a disconnect for electrical continuity between the main load terminal 68 and the load terminal brace 70.

Figure 8:
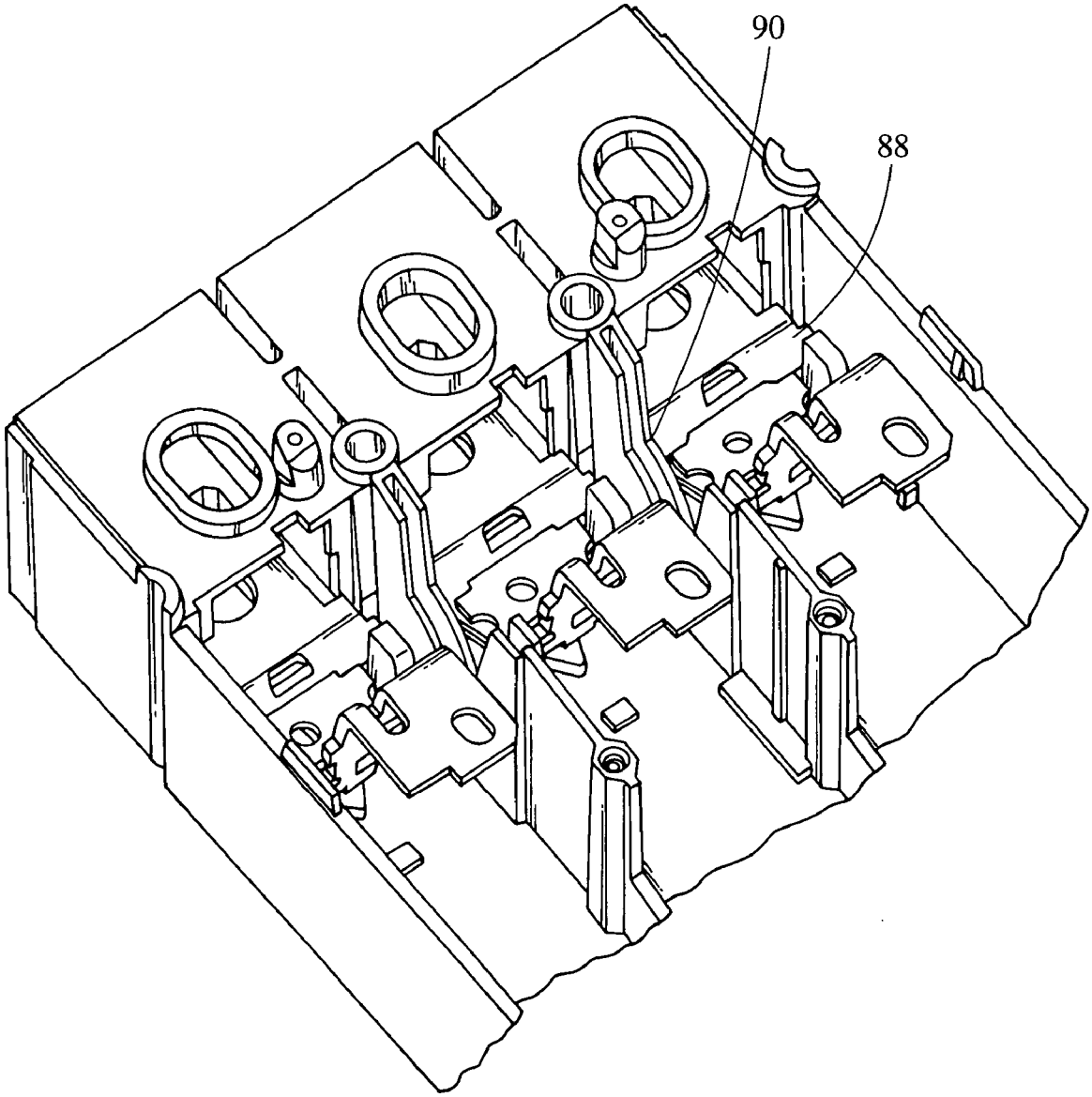
FIG. 8 is a perspective view of a circuit breaker housing according to one embodiment of the present invention.

As shown in FIG. 5, the load terminal brace 70 further includes two tabs 84, 86 which extend generally orthogonal to the second end 80 of the terminal brace 70. In use, the two tabs 84, 86 fit into corresponding recesses 88, 90 of the circuit breaker housing (shown in FIG. 8). These two tabs 84, 86 are included to provide additional structural integrity to the system. Particularly, when the tabs 84, 86 are inserted into the recesses 88, 90, the recesses provide retention from rotational movement while the lug screw is being tightened. This reduces the movement to the bimetal. Also, because the tabs 84, 86 redistribute the torque forces, the base 23 of the circuit breaker 20 is less vulnerable to damage.

Figure 9:
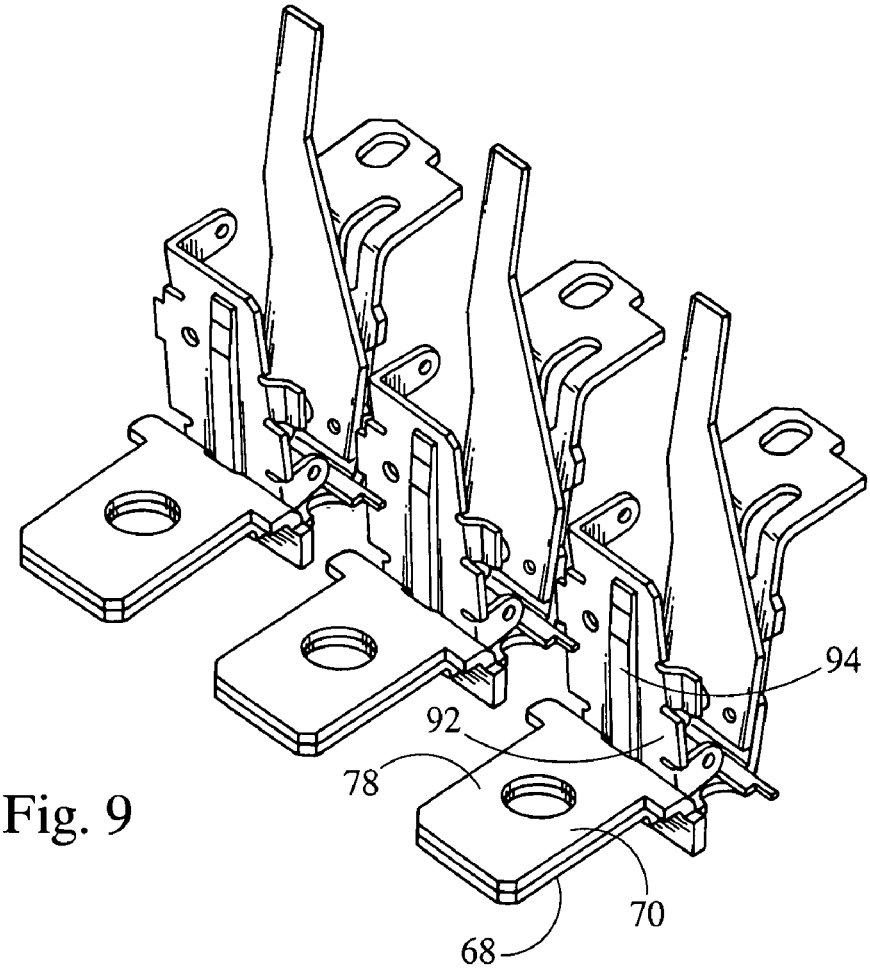
FIG. 9 is a perspective view of a main load terminal, load terminal brace, armature pivot and a bimetal according to one embodiment of the present invention.
Figure 10:
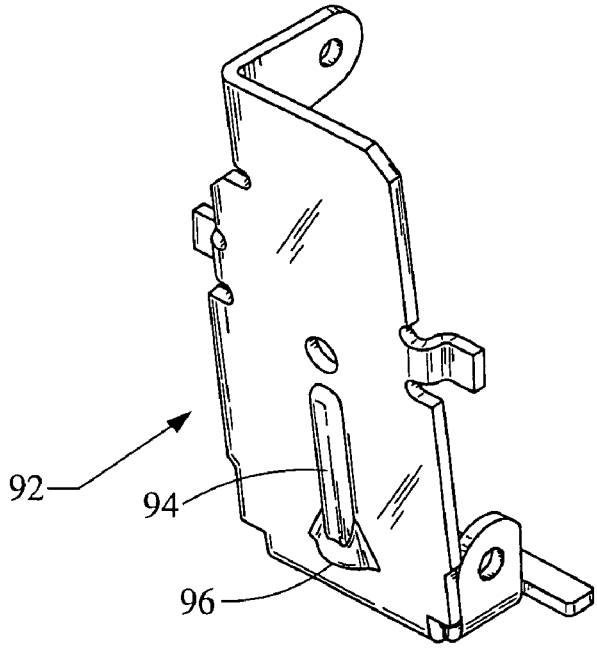
FIG. 10 is a perspective view of the armature pivot of FIG. 9.

As shown in FIGS. 9 and 10, the circuit breaker 20 also includes an armature pivot 92. The armature pivot 92 provides a mean to hold the load terminal brace 70 against the load terminal 68 after assembly. The armature pivot 92 includes a rib 94 to provide strength to the part. The rib 94 also includes a lanced bump (or protrusion) 96 (FIG. 10), which extends out from a bottom of the rib 94. The lanced bump 96 abuts the first end 78 of the load terminal brace 70 and holds the first end 78 of the load terminal brace 70 against the load terminal 68.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A load terminal assembly for use in a circuit breaker, comprising:

a main load terminal connected to a bimetal strip and further connected to a lug assembly for the attachment of a conductive cable thereto; and a load brace located on top of and astride the main load terminal, and having at least one tab extending downward on a side of the main load terminal and fitting into a corresponding pocket of a housing of the circuit breaker.

2. The terminal assembly of claim 1, wherein the load brace has two tabs, each tab extending downward on either side of the main load terminal to fit into two corresponding pockets of the circuit breaker housing.

3. The terminal assembly of claim 1, wherein the main load terminal includes a first arm and a second arm extending along a common line with the second arm generally parallel to the first arm, the first arm and the second arm being connected by a curved bend.

4. The terminal assembly of claim 3, wherein the second arm of the main load terminal connects to a trip unit containing the bimetal.

5. The terminal assembly of claim 1, further comprising an armature pivot of a trip unit pressed against the load brace.

6. The terminal assembly of claim 5, wherein the armature pivot includes a rib for holding the load brace in place.

7. The trip assembly of claim 6, wherein the rib includes a protrusion to hold the load brace onto the main load terminal.

8. A terminal assembly for use in a circuit breaker, comprising:

a first member; and a second member structured for placing on ton of and astride the first member, the second member including a pair of protruding anus extendable downwardly over the first member and being insertable into a corresponding pair of recesses in a circuit breaker housing such that the pair of protruding arms brace the first member against rotational force.

9. The terminal assembly of claim 8, wherein the first member is electrically and physically coupled to a bimetal strip.

10. The terminal assembly of claim 8, further comprising a holding member having surfaces shaped to press the second member against the first member.

11. The terminal assembly of claim 8:

wherein the first member is connected to a bimetal strip and can be connected to a conductive cable through an application of rotational force; and wherein the second member braces both of the first member and the bimetal strip against rotational movement through insertion of the second member into a housing of the circuit breaker, the housing being structured to withstand rotational forces.

12. The terminal assembly of claim 11, wherein the first member includes a first arm and a second arm extending along a common line with the second arm substantially parallel to the first arm, the second arm connected to the first arm with a curved bend.

* * * * *